US009199210B2

(12) United States Patent
Sacchet

(10) Patent No.: US 9,199,210 B2
(45) Date of Patent: Dec. 1, 2015

(54) AUTOMATIC DYE-METER

(75) Inventor: Alessandro Sacchet, Salmour (IT)

(73) Assignee: Stan Engineering Corp. S.R.L., Salmour (IT)

( * ) Notice: Subject to any disclaimer, the term of this patent is extended or adjusted under 35 U.S.C. 154(b) by 342 days.

(21) Appl. No.: 14/004,987

(22) PCT Filed: Mar. 12, 2012

(86) PCT No.: PCT/IT2012/000069
§ 371 (c)(1),
(2), (4) Date: Sep. 13, 2013

(87) PCT Pub. No.: WO2012/123977
PCT Pub. Date: Sep. 20, 2012

(65) Prior Publication Data

US 2014/0000760 A1 Jan. 2, 2014

(30) Foreign Application Priority Data

Mar. 14, 2011 (IT) ..... TO2011A0232

(51) Int. Cl.
*B01F 15/04* (2006.01)
*B01F 11/00* (2006.01)
*B01F 13/10* (2006.01)
*B01F 15/00* (2006.01)

(52) U.S. Cl.
CPC ..... *B01F 15/0445* (2013.01); *B01F 11/0017* (2013.01); *B01F 13/1055* (2013.01); *B01F 15/00123* (2013.01); *B01F 15/00266* (2013.01); *B01F 15/00311* (2013.01); *B01F 15/00318* (2013.01); *B01F 15/00422* (2013.01); *B01F 15/00428* (2013.01); *B01F 15/0454* (2013.01)

(58) Field of Classification Search
CPC ..... B01F 15/0441; B01F 15/0445
USPC ..... 141/83, 100–104, 181; 222/144.5; 700/240, 242
See application file for complete search history.

(56) References Cited

U.S. PATENT DOCUMENTS 3,878,907 A * 4/1975 Morick ..... B01F 13/1058 141/100
5,464,047 A * 11/1995 Muscara ..... B01F 13/1055 141/1
5,474,211 A * 12/1995 Hellenberg ..... B01F 13/1058 141/104
5,835,982 A * 11/1998 Lanaro ..... G01G 17/04 141/101
5,934,344 A * 8/1999 Wainberg ..... B01F 13/1055 141/100
6,105,636 A * 8/2000 Scatizzi ..... D06B 23/10 141/130

(Continued)

*Primary Examiner* — Timothy L Maust
(74) *Attorney, Agent, or Firm* — Jennifer L. Bales; Macheledt Bales LLP

(57) ABSTRACT

An automatic dye-meter (1) is described, composed of at least one first compartment (3) for stocking and storing a plurality of bottles (5) containing the dyeing components, each one of such bottles (5) being equipped with at least one plug equipped with pumping means for such component, such bottles (5) being arranged inside such first compartment (3) according to a known order, at least one second compartment (7) for batching such components from such bottles (5) to obtain a final dyeing compound inside at least one mixing container (9) arranged inside such second compartment (7), handling means (11) adapted to take at least one of such bottles (5) from such first compartment (3), transport such bottle (5) from such first compartment (3) to such second compartment (7), incline such bottle (5), actuate such pumping means to allow pouring and batching such component inside such mixing container (9), and take back such bottle (5) inside such first compartment (3).

10 Claims, 3 Drawing Sheets

(56) References Cited

U.S. PATENT DOCUMENTS 6,457,496 B1 * 10/2002 Chuang ..... B01F 13/1058 141/100
6,957,672 B2 * 10/2005 Taylor ..... B01F 13/1055 141/104
7,434,708 B2 * 10/2008 Voskuil ..... F16K 11/0876 141/103
7,527,078 B2 * 5/2009 Driessen ..... B01F 13/1058 141/104
7,789,111 B2 * 9/2010 Luehrsen ..... B01F 13/1058 141/104
8,567,455 B2 * 10/2013 Saranow ..... A45D 19/00 141/104
8,813,793 B2 * 8/2014 Boboltz ..... B01F 15/0445 141/104

* cited by examiner

AUTOMATIC DYE-METER

BACKGROUND ART

The present, invention refers to an automatic dye-meter.

BACKGROUND OF THE INVENTION

As known, dye-meters are batching machines for preparing dyeing composites, such as paints, enamels, pictures, typically comprising a plurality of stocking tanks for the individual dyeing components and batching and delivering devices for such components suitable to draw from the individual tanks accurate amounts of component, depending on the desired compositions, in order to arrive at the desired end compound. In general, the art has two families of dye-meter: those with tanks in a fixed position connected through ducts to a delivering head placed above a container of the final compound, in which delivery of the individual components can occur simultaneously, and those in which the tanks are placed on rotary platforms equipped with a kinematism adapted to position in turn the individual tanks, or individual sub-assemblies of tanks, on the container of the final compound in order to allow delivering the component. In general, therefore, the above types of dye-meters provide that the individual dyeing composites are poured into their related stocking tanks from the containers inside which they are available on the market. Alternatively, the art provides for dye-meters, such as for example the one disclosed in WO-A1-2010113186 of the same Applicant, in which the batching and delivering device directly draw from the commercial containers of the individual dyeing components in which particular covers are arranged, comprising integrated pumping and stirring means.

However, a current technical trend nowadays is marketing the dyeing components, especially in the particular sector of motor vehicle body, inside plastic bottles that must be stored inside special thermostatic cabinets and do not require any more a continuous stirring of the component inside them: currently, however, there are no specific dye-meters that allow the automatic batching of individual dyeing components directly from their commercial bottles. In fact, usually, in order to obtain a dyeing component aimed for painting a vehicle, an operator proceeds, depending on the standard formulation of the compound usually provided by the supplier of the vehicle itself, taking from the cabinet every time the individual bottles of the component pointed out by the formulation, stirring such bottles in order to revive and homogenise the components therein, by manually weighing on suitable balances the amount of component designated by the formulation, and putting again the bottles inside the cabinet. Obviously, above all in case of particularly complex dyeing compounds, the execution of the above described operations for every single bottle of dyeing component requires a long interval of time. Moreover, the completely manual execution of such operations, above all those pertaining to the selection of the individual bottles and the weighing of the batches of individual components, can often be subjected to human errors that, taking into account the non-neglected cost of the affected paints, have a negative outcome on the economy of such operations.

SUMMARY OF THE INVENTION

Therefore, object of the present invention is solving the above prior art problems by providing an automatic dye-meter, in particular for the vehicle body sector, that allows automatically batching individual dyeing components directly from commercial bottles.

Another object of the present invention is providing an automatic dye-meter that allows making the operations of preparing a dyeing compound, quicker, more efficient and reliable, in particular for painting motor vehicles in the field of bodies, directly from the commercial bottles of the individual components.

The above and other objects and advantages of the invention, as will appear from the following description, are obtained with an automatic dye-meter as described in claim 1. Preferred embodiments and non-trivial variations of the present invention are the subject matter of the dependent claims.

It is intended that the claims are an integral part of the present specification.

It will be immediately obvious that numerous variations and modifications (for example related to shape, sizes, arrangements and parts with equivalent functionality) can me made to what is described, without departing from the scope of the invention as appears from the enclosed claims.

BRIEF DESCRIPTION OF THE DRAWINGS

The present invention will be better described by some preferred embodiments thereof, provided as a non-limiting example, with reference to the enclosed drawings, in which.

DETAILED DESCRIPTION OF PREFERRED EMBODIMENTS

Figure 1:
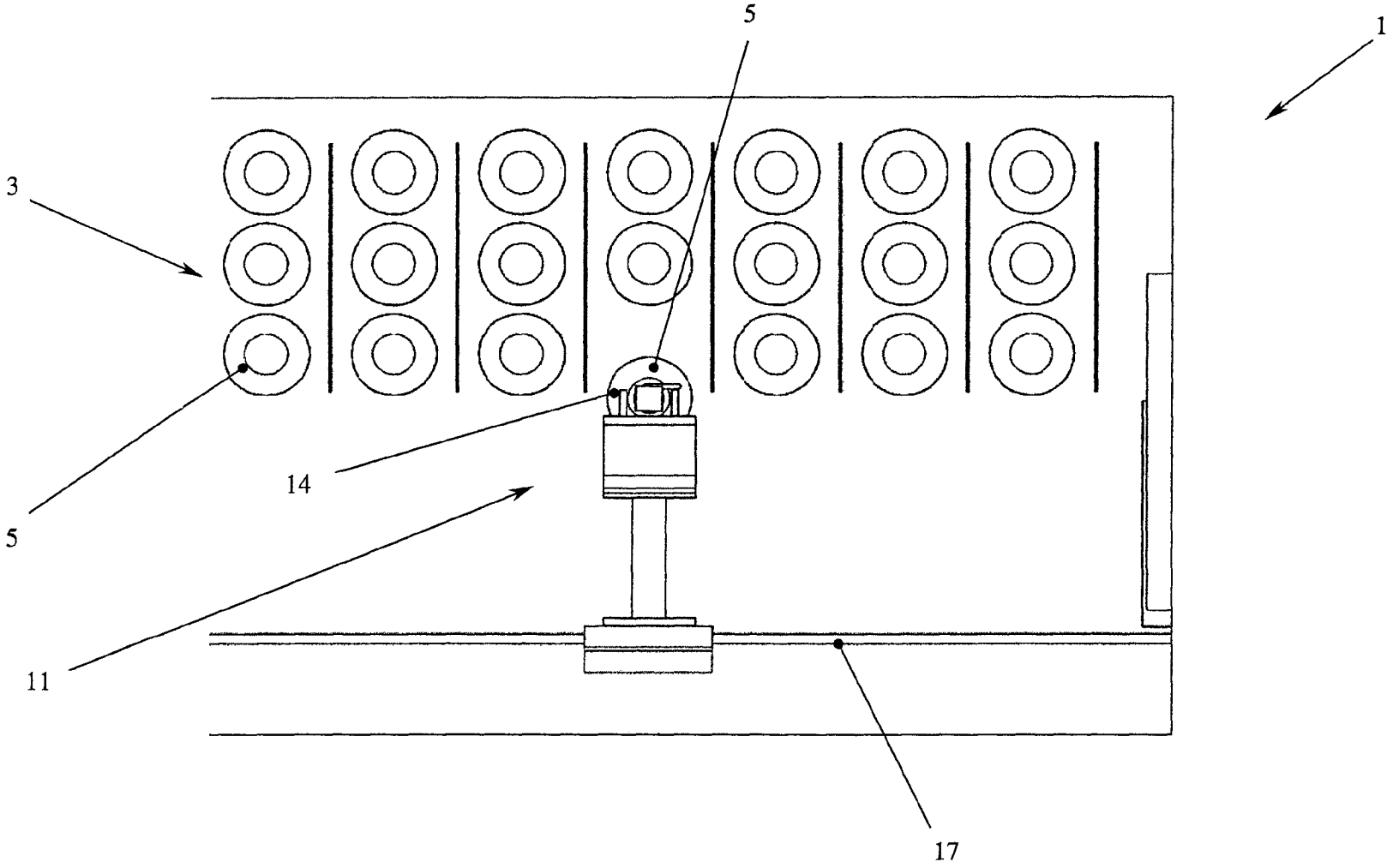
FIG. 1 shows a schematic top view of a preferred embodiment of the automatic dye-meter according to the present invention in an operating position thereof.
Figure 2:
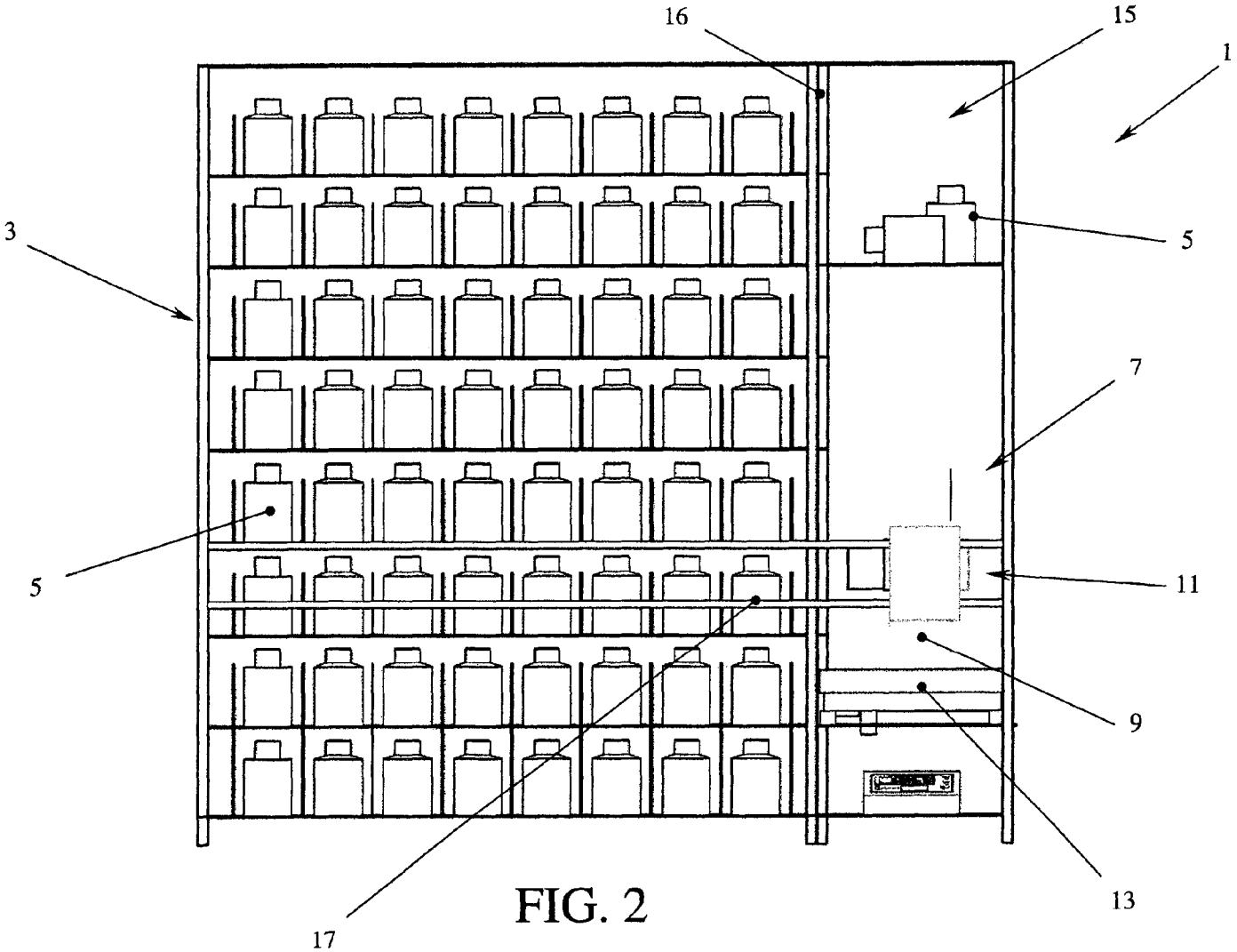
FIG. 2 shows a schematic front view of a preferred embodiment of the automatic dye-meter according to the present invention in another operating position thereof.
Figure 3:
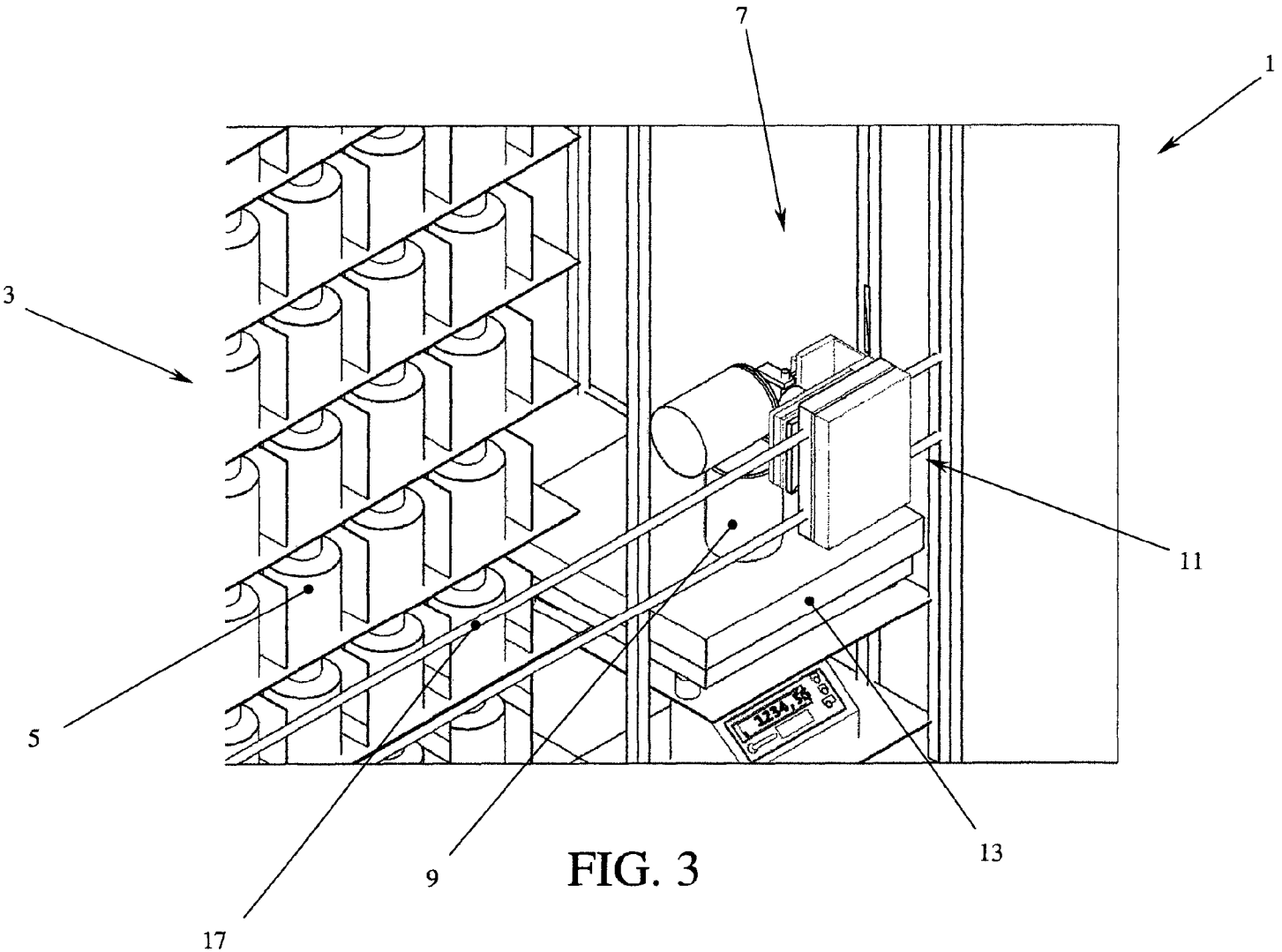
FIG. 3 shows a detailed front view of the automatic dye-meter according to the present invention in its operating position of FIG. 2.

With reference to the Figures, it is possible to note that the automatic dye-meter 1 according to the present invention is composed of at least one first compartment 3 for stocking and storing a plurality of bottles 5 containing dyeing components, each one of which is equipped with at least one plug equipped with pumping means for such component, such bottles 5 being arranged inside such first compartment 3 according to a known order, at least one second compartment 7 for batching such components from such bottles 5 for preparing a final dyeing compound inside at least one mixing container 9 arranged inside such second compartment 7, handling means 11 adapted to take at least one of such bottles 5 from such first compartment 3 (FIG. 1), transporting such bottle 5 from such first compartment 3 to such second compartment 7 (FIGS. 2 and 3), possibly in the meantime stirring such bottle 5, suitably inclining such bottle 5, actuating such pumping means to allow pouring and batching (volumetric or weigh-type with the help of an electronic balance) of the component therein contained inside the mixing container 9, take again such bottle 5 (obviously after having taken it back into such a position as to prevent possible pouring) inside the first compartment 3 in the previously-occupied position.

The first compartment 3 and possibly also the second compartment 7 can be equipped with means, known in the art, for suitably internally conditioning and heating/cooling such compartments 3, 7 and guarantee the correct storage of the components contained inside the bottles 5.

Obviously, the type of arrangement of the bottles inside the first compartment 7 can be various: for example, as shown in the Figures, the bottles 5 can be arranged inside the first compartment 3 on a plurality of supporting shelves, in order to obtain an array-type arrangement composed of n rows and m columns, each position n, m of such array being occupied, for example, by one bottle 5 containing a different and distinct dyeing component. Obviously, if n=1 or m=1, the arrangement is of the vector (linear) type, respectively horizontal or vertical. As spares, each position n, m can further be occupied by a queue of a plurality of bottles 5 containing the same dyeing component.

Obviously, the automatic dye-meter 1 according to the present invention is equipped with suitable control means adapted to cooperate with the handling means 11 to allow the correct drawing of the individual bottles 5 from the correct position n, m inside the first compartment 3: for such purpose, for example, such control means cooperate and communicate with a data base containing the mapping of the known order of the positions of the individual bottles 5 inside the first compartment 3 in such a way as to know the position n, m occupied by each distinct component and correctly address the handling means 11 for taking and re-positioning the related bottle 5. In order to increase the reliability of the automatic dye-meter 1 according to the present invention, each bottle 5 can be equipped with suitable individual recognition means, such as for example a bar code or a RFID tag, that can be detected by related reading means arranged on the handling means 11 in order to ascertain the coincidence between the type of component that hypothetically occupies a certain position n, m in the first compartment 3 and signalled by the control means depending on the mapping contained in the data base, and the bottle 5 that actually occupies such position: in case of absence of such coincidence, for example if an operator has arranged one or more bottles 5 inside the first compartment 3 differently from what is included in the mapping of the positions signalled to the control means, the automatic dye-meter 1 according to the present invention can timely stop the procedure for preparing the dyeing compound in such a way as to avoid any waste of the products.

Depending on the formulation of the dyeing compound to be obtained starting from the components contained inside the bottles 5, provided for example by a data base cooperating and communicating with such control means of the automatic dye-meter 1 according to the present invention or by a PC already currently used by the body operators, the handling means 11 are therefore able to advantageously drawing every time the individual bottles 5 containing the necessary components for obtaining the compound from the first compartment 5 and to pour its contents inside the container 1 till the required batching is reached. Obviously, batching of the individual components can occur through any mode known in the art: for example, in case of a weight-type batching, the automatic dye-meter 1 as shown in the Figures will be equipped with at least one balance 13 arranged below the mixing container 9 and the pumping means could comprise a simple peristaltic pump actuated by the handling means 11 till the required weight-type batching is reached. For such purpose, the balance 13 can cooperate with the control means of the automatic dye-meter 1 according to the present invention in order to signal when the required batch of the individual component has been reached, such control means therefore driving the handling means to stop the actuation of the pumping means, and therefore the component delivery, and to take back the bottle 5 into its own position inside the first compartment 3. Instead, in the case, not shown, in which there is a volumetric-type batching, the pumping means can comprise a rotary pump with progressive recesses of the known type that takes care of communicating with the control means to deliver the required batch of component and then take back the bottle 5 into its own position inside the first compartment 3.

It is moreover possible to provide that the dye-meter 1 according to the present invention comprises, preferably inside the second compartment 7, at least one room 15 for replacing and loading the bottles. In fact, when the control means and their related sensors detect, in any suitable way, known in the art, that the contents inside a bottle 5 have finished, they take care of sending an alert signal: depending on such signal, an operator therefore takes care of positioning a new bottle 5 inside such room 15: once having detected the presence of a new bottle inside such room 15 through the most suitable sensors, the control means take care of driving the handling means to remove the empty bottle 5, for example by taking it too inside the room 15, and to replace it with a new one, taking it from the same, room 15.

Obviously, the handling means 11 can be made using any mechanical-electronic solution suitable for such purpose: merely as an example, it is possible to note that the handling means 11 can comprise at least one catching device 14 movable along a translation structure composed of at least one vertical sliding guide 16 movable along an horizontal direction and at least one horizontal sliding guide 17 movable along a vertical direction: the guides 16, 17 can therefore be suitably handled by actuating means, known in the art, and driven by the control means in order to be taken every time to cross themselves next to a specific position inside the first compartment 3, such position corresponding to a position n, m occupied by a bottle 5 to be taken. The catching device 14 is therefore taken, again under the action of actuating means, known in the art, driven by the control means, to the crossing position between the guides 16, 17 in such a way as to take such bottle 5. The translation structure, and in particular the guides 16, 17, is then again handled under the action of the control means in order to transport the bottle 5 inside the second compartment 7 in such a position as to allow inclining and pouring the component contained therein inside the mixing container 9: once having ended the batching of the component, the translation structure is handled under the action of the control means in order to take again the bottle 5 inside the first compartment 3 in its own previously-occupied position (or possibly in the replacement room 15 if empty): obviously, the above operations are repeated for every individual bottle 5 containing the necessary component for obtaining the dyeing compound according to the formulation communicated to the control means.

The catching device 14, preferably composed of at least one gripping pliers for the bottle 5, is thereby articulated in such a way as to allow inclining, in a way controlled by the control means, such bottle 5 during its delivery and batching inside the mixing container 9, and comprises means for actuating the pumping means arranged on the plug of such bottle 5: possibly, the catching device 14 can further comprise the means for reading the individual recognising means and/or the stirring means for such bottles 5.

What is claimed is:

1. An automatic dye-meter composed of at least one first compartment for stocking and storing a plurality of bottles containing dyeing components, the bottles being arranged inside the first compartment, at least one second compartment for batching the components from the bottles to obtain a final dyeing compound inside at least one mixing container arranged inside the second compartment, handling means adapted to take at least one of the bottles from the first compartment, transport the bottle from the first compartment to the second compartment, incline the bottle, pour and batch the component inside the mixing container, and take again the bottle inside the first compartment, wherein:

each one of the bottles is equipped with at least one plug equipped with pumping means of the component, the handling means being further adapted to actuate the pumping means to allow pouring and batching the component inside the mixing container;

the dye-meter comprises at least one room for replacing the bottles, the room being arranged inside the second compartment;

the bottles are arranged inside the first compartment according to an array-type arrangement composed of n rows and m columns, each position n, m of the array being occupied by a bottle containing a different and distinct dyeing component, the dye-meter being equipped with control means adapted to cooperate with the handling means to allow correctly taking the individual bottles from the position n, m inside the first compartment, the control means cooperating and communicating with a data base containing a mapping of the known order of the positions n, m of the individual bottles inside the first compartment; and the batching is of the weight type, the dye-meter comprises at least one balance arranged below the mixing container, the balance cooperating with the control means in order to signal when a required dose of the individual component has been reached, and the pumping means comprise a peristaltic pump actuated by the handling means.

2. The automatic dye-meter of claim 1, wherein each one of the bottles is equipped with individual recognition means adapted to be detected by related reading means arranged on the handling means.

3. The automatic dye-meter of claim 2, wherein the control means cooperate and communicate with a data base or a PC containing formulations of the dyeing compounds starting from the components.

4. The automatic dye-meter of claim 1, wherein the handling means comprise at least one catching device mobile along a translation structure composed of at least one vertical sliding guide mobile along an horizontal direction and at least one horizontal sliding guide mobile along a vertical direction, the catching device being articulated in such a way as to allow inclining in a controlled way the bottle during delivery and batching inside the mixing container and comprising means for actuating the pumping means arranged on the plug of the bottle.

5. The automatic dye-meter of claim 4, wherein the catching device comprise at least one stirrer adapted to stir the bottles along a plurality of directions.

6. An automatic dye-meter composed of at least one first compartment for stocking and storing a plurality of bottles containing dyeing components, the bottles being arranged inside the first compartment, at least one second compartment for batching the components from the bottles to obtain a final dyeing compound inside at least one mixing container arranged inside the second compartment, handling means adapted to take at least one of the bottles from the first compartment, transport the bottle from the first compartment to the second compartment, incline the bottle, pour and batch the component inside the mixing container, and take again the bottle inside the first compartment, wherein:

each one of the bottles is equipped with at least one plug equipped with pumping means of the component, the handling means being further adapted to actuate the pumping means to allow pouring and batching the component inside the mixing container;

the dye-meter comprises at least one room for replacing the bottles, the room being arranged inside the second compartment;

the bottles are arranged inside the first compartment according to an array-type arrangement composed of n rows and m columns, each position n, m of the array being occupied by a bottle containing a different and distinct dyeing component, the dye-meter being equipped with control means adapted to cooperate with the handling means to allow correctly taking the individual bottles from the position n, m inside the first compartment, the control means cooperating and communicating with a data base containing a mapping of the known order of the positions n, m of the individual bottles inside the first compartment;

the batching is of the volumetric type and the pumping means comprise a rotary pump with progressive recesses communicating with the control means in order to deliver the required batch of the component.

7. The automatic dye-meter of claim 6, wherein each one of the bottles is equipped with individual recognition means adapted to be detected by related reading means arranged on the handling means.

8. The automatic dye-meter of claim 7, wherein the control means cooperate and communicate with a data base or a PC containing formulations of the dyeing compounds starting from the components.

9. The automatic dye-meter of claim 6, wherein the handling means comprise at least one catching device mobile along a translation structure composed of at least one vertical sliding guide mobile along an horizontal direction and at least one horizontal sliding guide mobile along a vertical direction, the catching device being articulated in such a way as to allow inclining in a controlled way the bottle during delivery and batching inside the mixing container and comprising means for actuating the pumping means arranged on the plug of the bottle.

10. The automatic dye-meter of claim 9, wherein the catching device comprise at least one stirrer adapted to stir the bottles along a plurality of directions.

* * * * *